US006722382B2

(12) United States Patent
Wang

(10) Patent No.: US 6,722,382 B2
(45) Date of Patent: Apr. 20, 2004

(54) UMBRELLA

(75) Inventor: Max Wang, No. 19, Ta-Yuan 13th St., Tai-Ping City, Taichung Hsien (TW)

(73) Assignee: Max Wang, Tai-Ping (TW)

( * ) Notice: Subject to any disclaimer, the term of this patent is extended or adjusted under 35 U.S.C. 154(b) by 65 days.

(21) Appl. No.: 10/214,075

(22) Filed: Aug. 7, 2002

(65) Prior Publication Data

US 2004/0025915 A1 Feb. 12, 2004

(51) Int. Cl.[7] ..... A45B 25/00
(52) U.S. Cl. ..... 135/30; 28/48
(58) Field of Search ..... 135/28, 29, 30, 135/31, 48

(56) References Cited

U.S. PATENT DOCUMENTS 449,716 A * 4/1891 Thorp ..... 135/32
4,576,191 A * 3/1986 Schultes et al. ..... 135/30
5,193,566 A * 3/1993 Chen ..... 135/28
5,964,235 A * 10/1999 Wang ..... 135/28

* cited by examiner

*Primary Examiner*—Carl D. Friedman
*Assistant Examiner*—Naoko Slack
(74) *Attorney, Agent, or Firm*—Webb Ziesenheim Logsdon Orkin & Hanson, P.C.

(57) ABSTRACT

An umbrella includes a tubular runner slidably sleeved on a stem between upper and lower positions. A tubular upper end portion of the stem defines a plurality of angularly displaced slots such that anchored segments of an anchored wire are exposed therefrom for pivotally mounting anchoring ends of a plurality of ribs. The ribs have distal ends disposed at an underside of a canopy for supporting the canopy in spread-out and collapsed positions when the runner is moved to the upper and lower positions, respectively. The ribs can be brought into close proximity of the stem after retraction for facilitating storage and carrying.

5 Claims, 8 Drawing Sheets

UMBRELLA

BACKGROUND OF THE INVENTION

1. Field of the Invention

This invention relates to an umbrella, more particularly to an umbrella having a stem formed with a plurality of slots for receiving anchoring ends of a plurality of ribs that are pivoted to an anchored wire.

2. Description of the Related Art

Referring to FIGS. 1 and 2, a conventional umbrella is shown to include an elongate stem 1 and a runner 3 which is sleeved slidably on the stem 1 to connect pivotally with a stretch assembly 5 for supporting a rib assembly 4. A notch 2 includes a sleeve portion 201 which is sleeved on an upper end of the stem 1, and a mounting portion 202 for pivotally connecting a plurality of ribs 401 of the rib assembly 4. The runner 3 is movable between an upper position for stretching the rib assembly 4 and a lower position for collapsing the same. A spring-loaded stop 101 is disposed in the stem 1 so as to retain the runner 3 in the upper position.

However, the ribs 401 cannot be brought into close proximity of the stem 1 due to the thickness of the sleeve portion 201 after being collapsed, as shown in FIG. 2, thereby resulting in inconvenient carrying and storage.

SUMMARY OF THE INVENTION

The object of the present invention is to provide an umbrella in which ribs can be brought into close proximity of a stem after being collapsed so as to facilitate storage and carrying.

According to this invention, the umbrella includes an elongate stem which has a tubular upper end portion, and a lower end portion extending from the upper portion along an axis. The upper end portion has a top edge wall with inner and outer peripheries respectively surrounding the axis, an outer surrounding wall surface which extends downwardly from the outer periphery and which surrounds the axis, and an inner surrounding wall surface which extends downwardly from the inner periphery and which is disposed opposite to the outer surrounding wall surface. The upper end portion defines a plurality of slots which are angularly displaced from one another. Each of the slots extends radially and inwardly relative to the axis, extends from the top edge wall toward the lower end portion, and terminates at a slot edge wall. An anchored wire extends around the axis, and is disposed inwardly and radially of the inner surrounding wall surface. The wire has a plurality of anchored segments which are disposed to be respectively exposed from the slots such that each of the anchored segments is accessible radially. Each of the anchored segments is disposed proximate to the top edge wall along the axis. A canopy is mounted on the top edge wall. A cap member is disposed to fasten the canopy to the top edge wall. A rib assembly includes a plurality of ribs. Each rib has an anchoring end which is pivoted to a respective one of the anchored segments, a distal end which is disposed opposite to the anchoring end radial to the axis and which is disposed at an underside of the canopy to support the canopy in a spread-out position and in a collapsed position, and a bent portion which extends from the anchoring end toward the distal end. The bent portion is formed by bending a respective one of the ribs which is adjacent to the anchoring end towards the axis, thereby bringing the bent portion close to the slot edge wall. A tubular runner is slidably sleeved on the stem, and is movable between upper and lower positions respectively corresponding to the spread-out and collapsed positions of the canopy. A stretcher assembly is disposed to interconnect the rib assembly and the runner so as to stretch or retract the rib assembly, thereby placing the canopy in the spread-out position or the collapsed position when the runner is moved to the upper position or the lower position, respectively.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENTS

Figure 1:
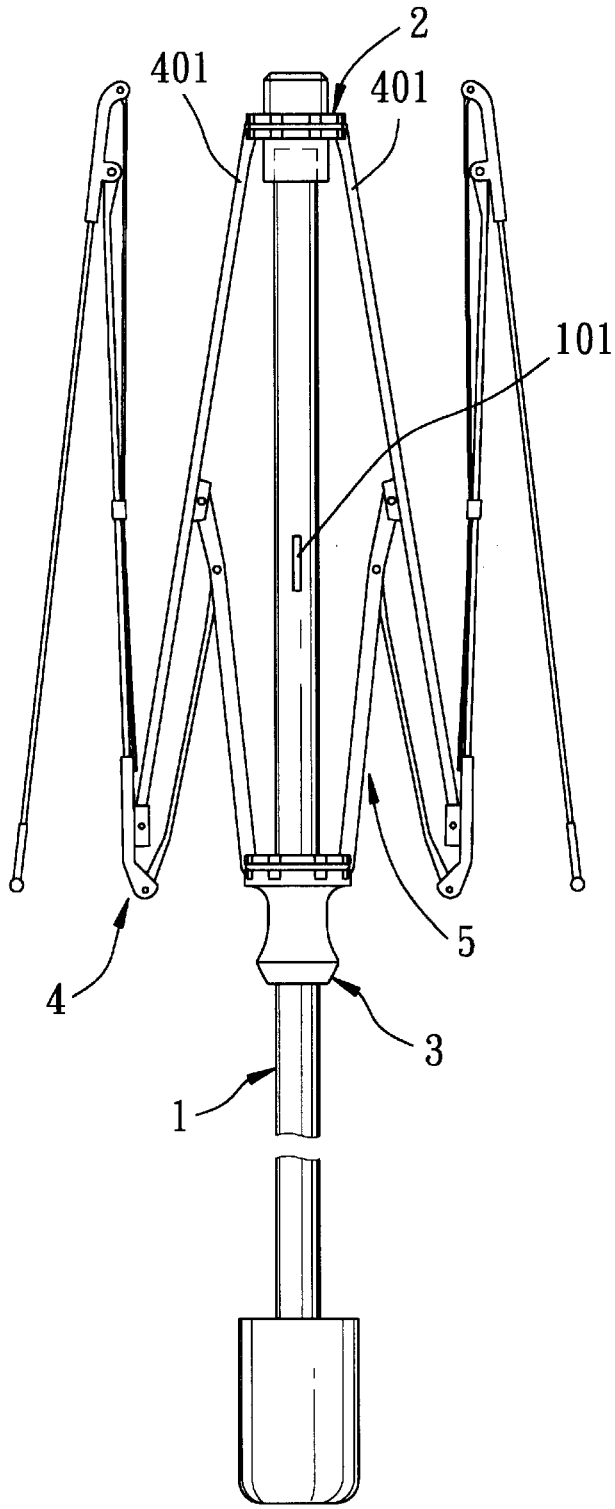
FIG. 1 PRIOR ART
FIG. 1 is a fragmentary schematic view of a conventional umbrella.
Figure 2:
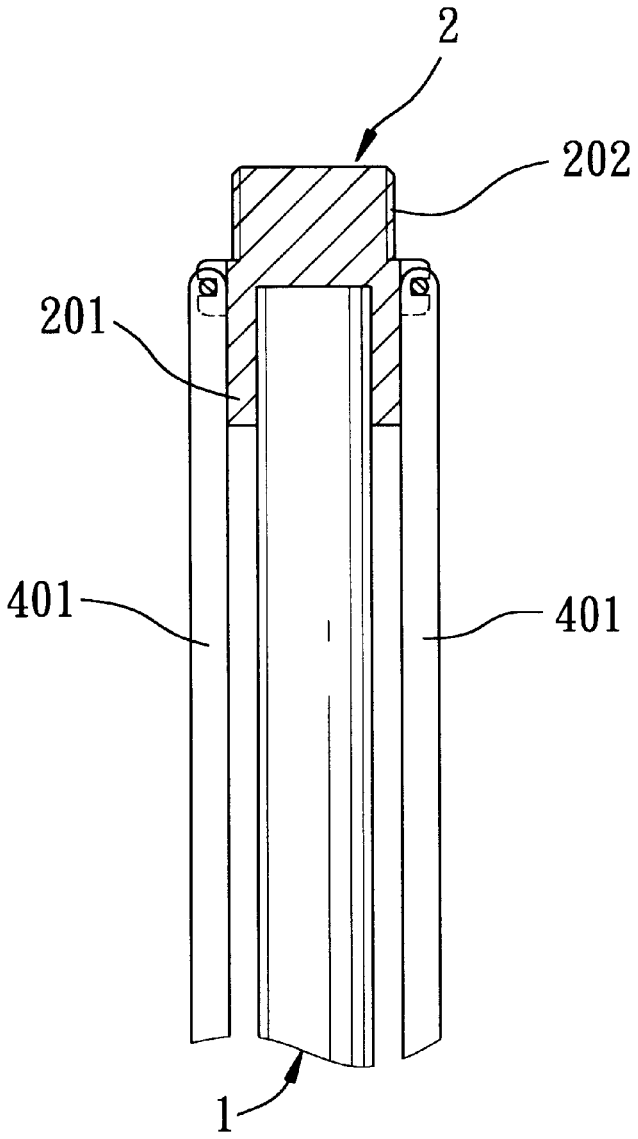
FIG. 2 PRIOR ART
FIG. 2 is a fragmentary schematic view of a notch of the conventional umbrella.

Before the present invention is described in greater detail, it should be noted that same reference numerals have been used to denote like elements throughout the specification.

Figure 3:
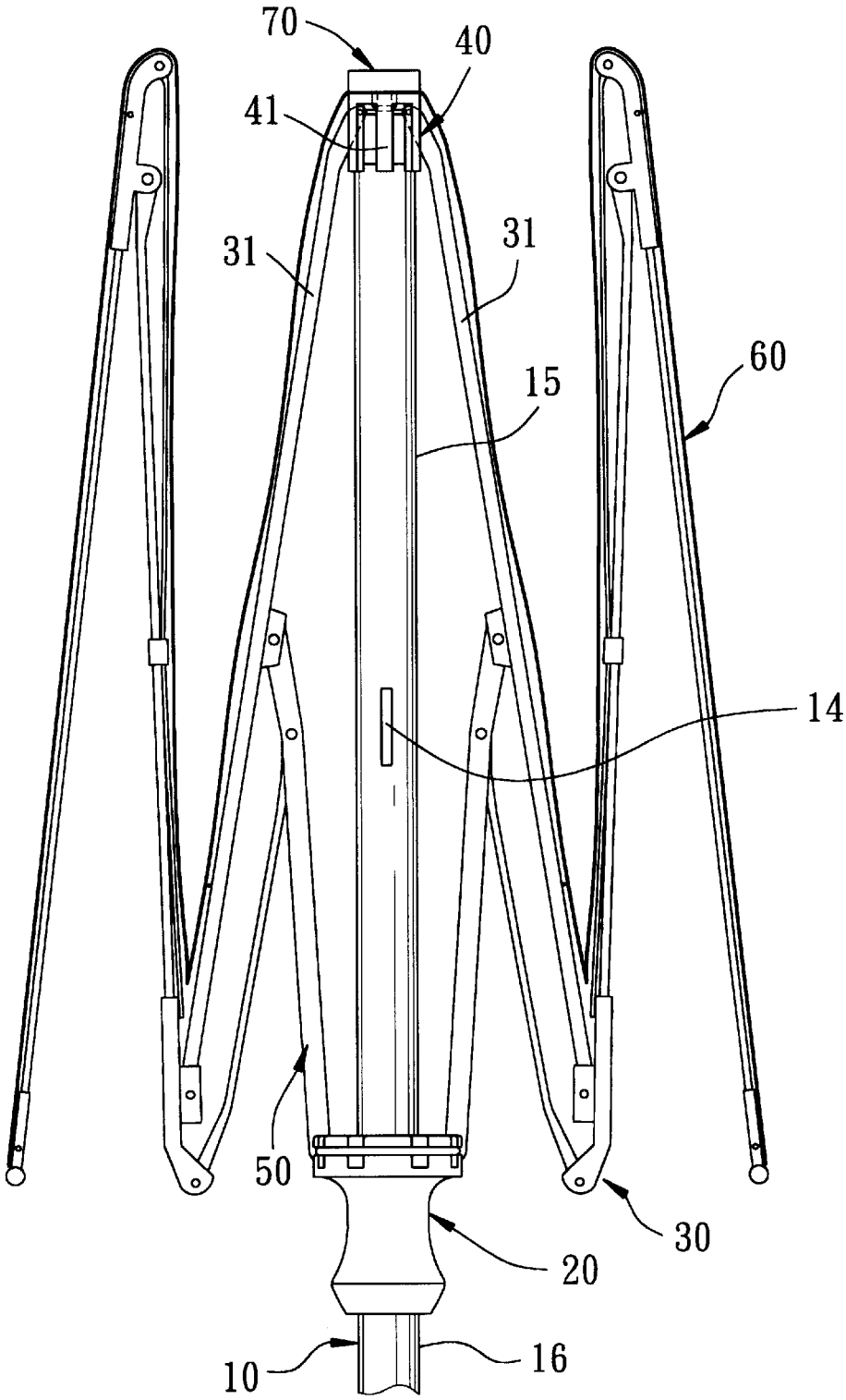
FIG. 3 is a fragmentary schematic view of a preferred embodiment of an umbrella according to this invention when folded.
Figure 4:
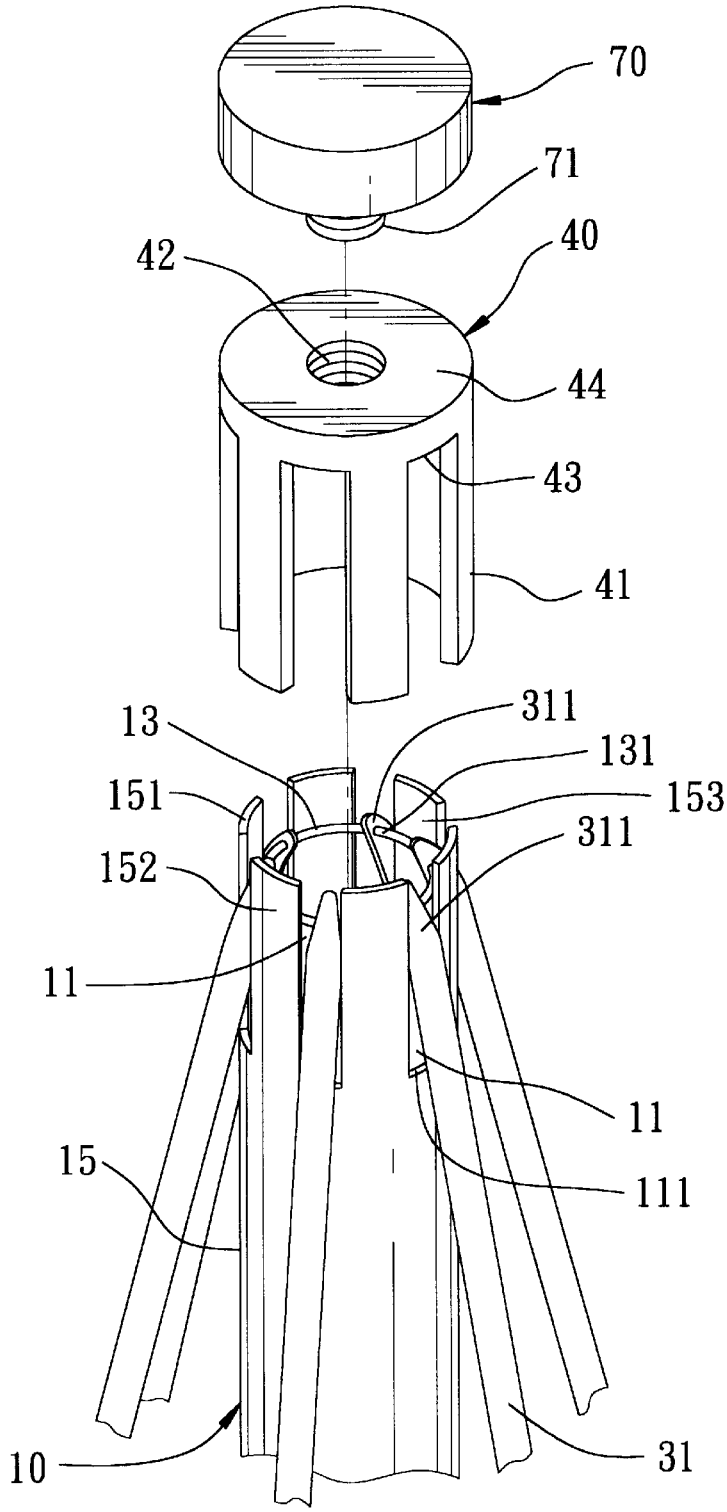
FIG. 4 is an exploded perspective view of the preferred embodiment in part.
Figure 5:
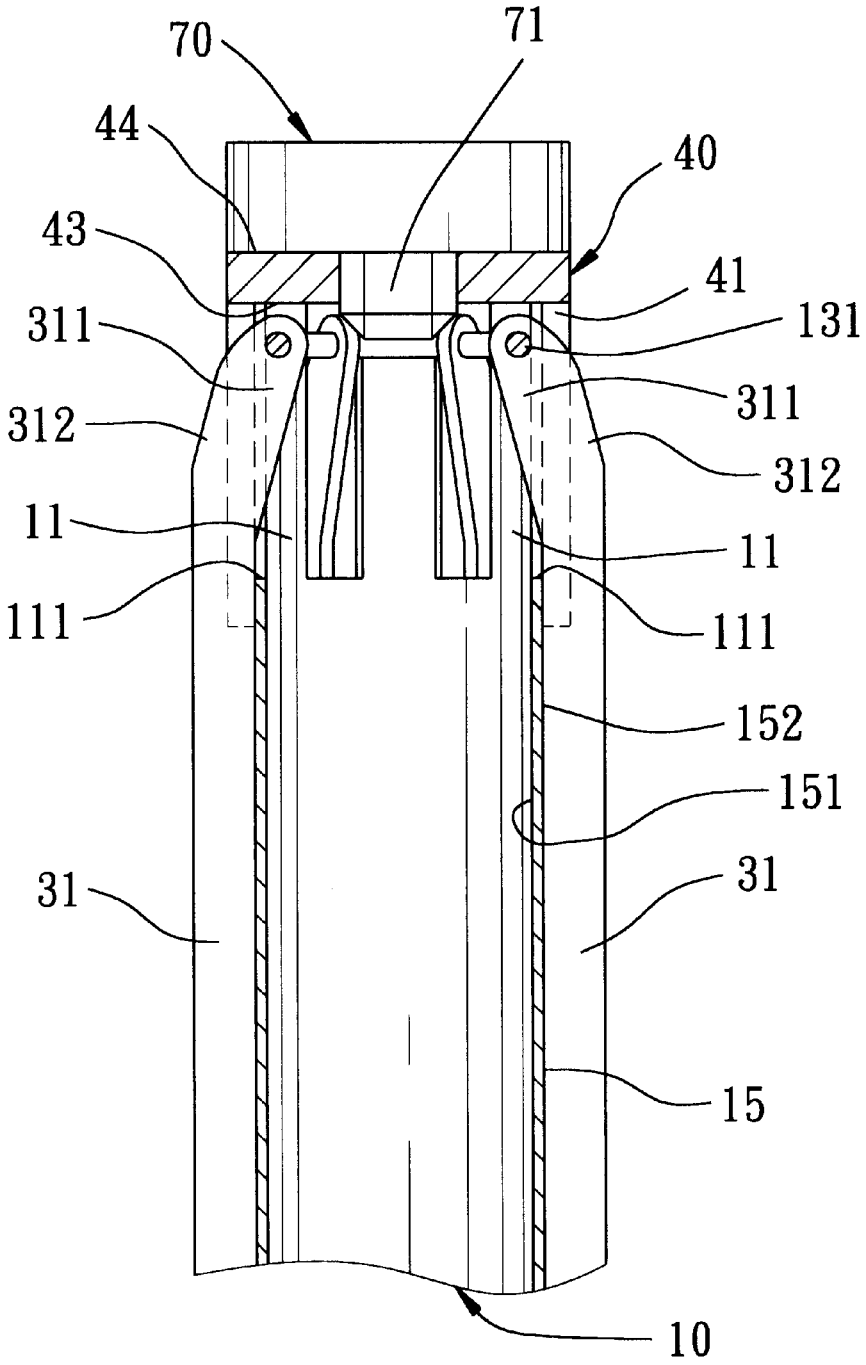
FIG. 5 is a partly sectional view of the preferred embodiment of FIG. 3 in a collapsed state.

Referring to FIGS. 3 to 5, the preferred embodiment of an umbrella according to the present invention is shown to comprise an elongate tubular stem 10 which has an upper end portion 15 and a lower end portion 16 opposite to each other along an axis. The upper end portion 15 has a top edge wall 151 with inner and outer peripheries which respectively surround the axis, an outer surrounding wall surface 152 which extends downwardly from the outer periphery of the top edge wall 151 and which surrounds the axis, and an inner surrounding wall surface 153 which extends downwardly from the inner periphery of the top edge wall 151 and which is disposed opposite to the outer surrounding wall surface 152. The upper end portion 15 is of an integrally single-piece construction, and defines a plurality of slots 11 which are angularly.displaced from one another. Each of the slots 11 extends radially and inwardly relative to the axis, extends from the top edge wall 151 toward the lower end portion 16, and terminates at a slot edge wall 111.

An anchored wire 13 extends around the axis, and is disposed inwardly and radially of the inner surrounding wall surface 153. The anchored wire 13 has a plurality of anchored segments 131 which are disposed to be respectively exposed from the slots 11 such that each of the anchored segments 131 is accessible radially. Each of the anchored segments 131 is disposed proximate to the top edge wall 151 along the axis.

A support mount 40 has a lower major wall surface 43 which abuts against the top edge wall 151 of the upper end portion 15 of the stem 10, an upper major wall surface 44 which is formed with a threaded hole 42 that extends along the axis, and a plurality of elongate limiting portions 41 which extend downwardly from a periphery of the lower major wall surface 43 and which are displaced angularly from one another about the axis. The limiting portions 41 are disposed radially and outwardly of the outer surrounding wall surface 152 of the upper end portion 15 of the stem 10 and between two adjacent ones of the slots 11. A canopy 60 is mounted on the upper major wall surface 44. A cap member 70 has a threaded bolt 71 which extends along the axis and which engages threadedly the threaded hole 42 so as to clamp the canopy 60 between the cap member 70 and the support mount 40.

A rib assembly 30 includes a plurality of ribs 31. Each rib 31 has an anchoring end 311 which is pivoted to a respective one of the anchored segments 131 of the anchored wire 13, a distal end which is disposed opposite to the anchoring end 311 radial to the axis and which is disposed at an underside of the canopy 60 to support the canopy 60 in a spread-out position and in a collapsed position, and a bent portion 312 which extends from the anchoring end 311 toward the distal end and which is formed by bending a respective one of the ribs 31 that is adjacent to the anchoring end 311, towards the axis. As such, the bent portions 312 of the ribs 31 can be brought close to the slot edge walls 111 of the upper end portion 15 of the slots 11 in the stem 10.

A tubular runner 20 is slidably sleeved on the stem 10, and is movable between upper and lower positions which respectively correspond to the spread-out and collapsed positions of the canopy 60.

A stretcher assembly 50 is disposed to interconnect the rib assembly 30 and the runner 20 so as to stretch or retract the rib assembly 30, thereby placing the canopy 60 in the spread-out position or the collapsed position when the runner 20 is moved to the upper position or the lower position, respectively.

A spring-loaded stop 14 is disposed in the stem 10 to retain the runner 20 in the upper position so as to spread the canopy 60. With reference to FIG. 5, when the canopy 60 is collapsed, since the anchoring ends 311 of the ribs 31 are pivoted to the anchored segments 131 which are disposed radially and inwardly of the inner surrounding wall surface 153 of the upper end portion 15 of the stem 10, and since the bent portions 312 are formed adjacent to the anchoring ends 311, the ribs 31 can be brought into close proximity of the stem 10 after the collapsing operation, thereby resulting in a compact size of the umbrella to facilitate storage and carrying. Moreover, by virtue of the elongate limiting portions 41, pivotal movement of the ribs 31 relative to the anchored segments 131 for supporting the canopy 60 between the spread-out and collapsed positions can be stabilized, and wavering of the ribs 31 can be prevented.

Figure 6:
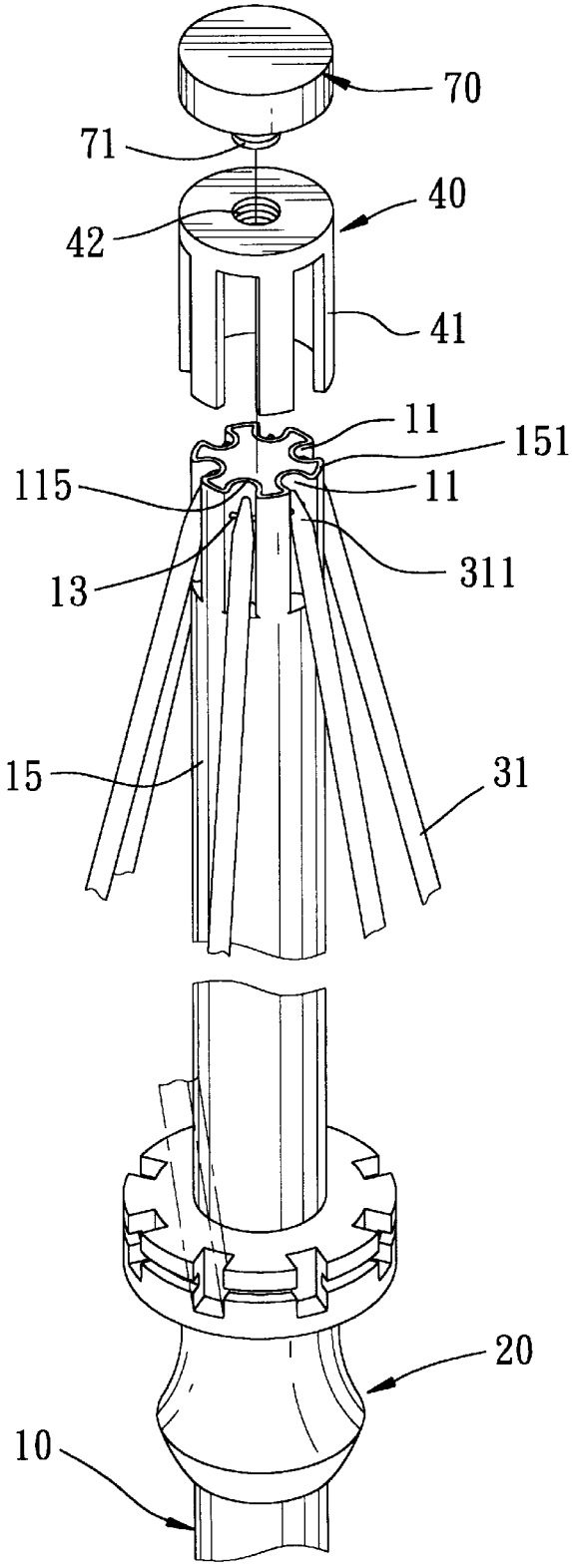
FIG. 6 is an exploded perspective view of another preferred embodiment of the umbrella according to this invention in part.
Figure 7:
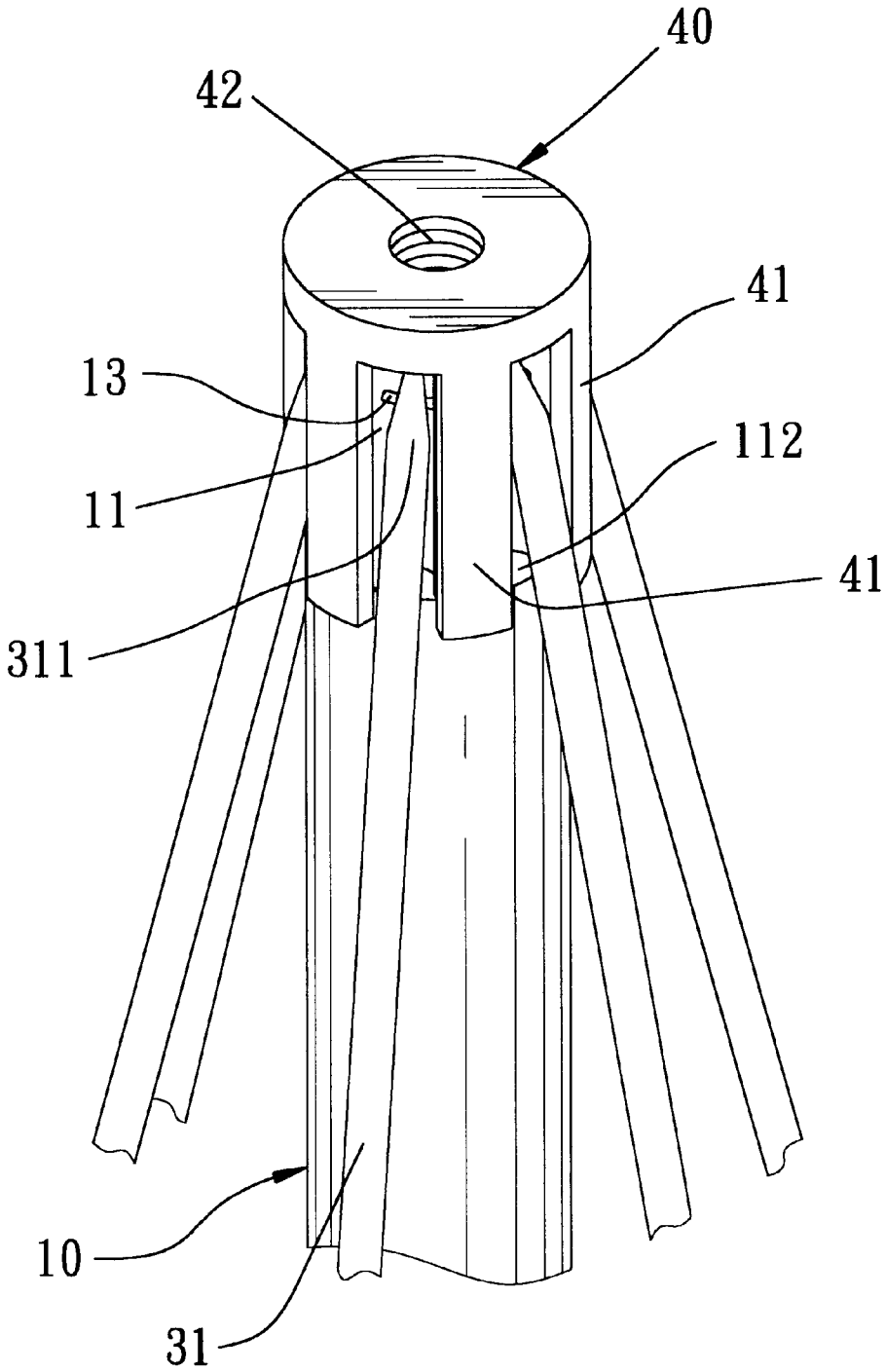
FIG. 7 is a fragmentary perspective view of the preferred embodiment of FIG. 6.
Figure 8:
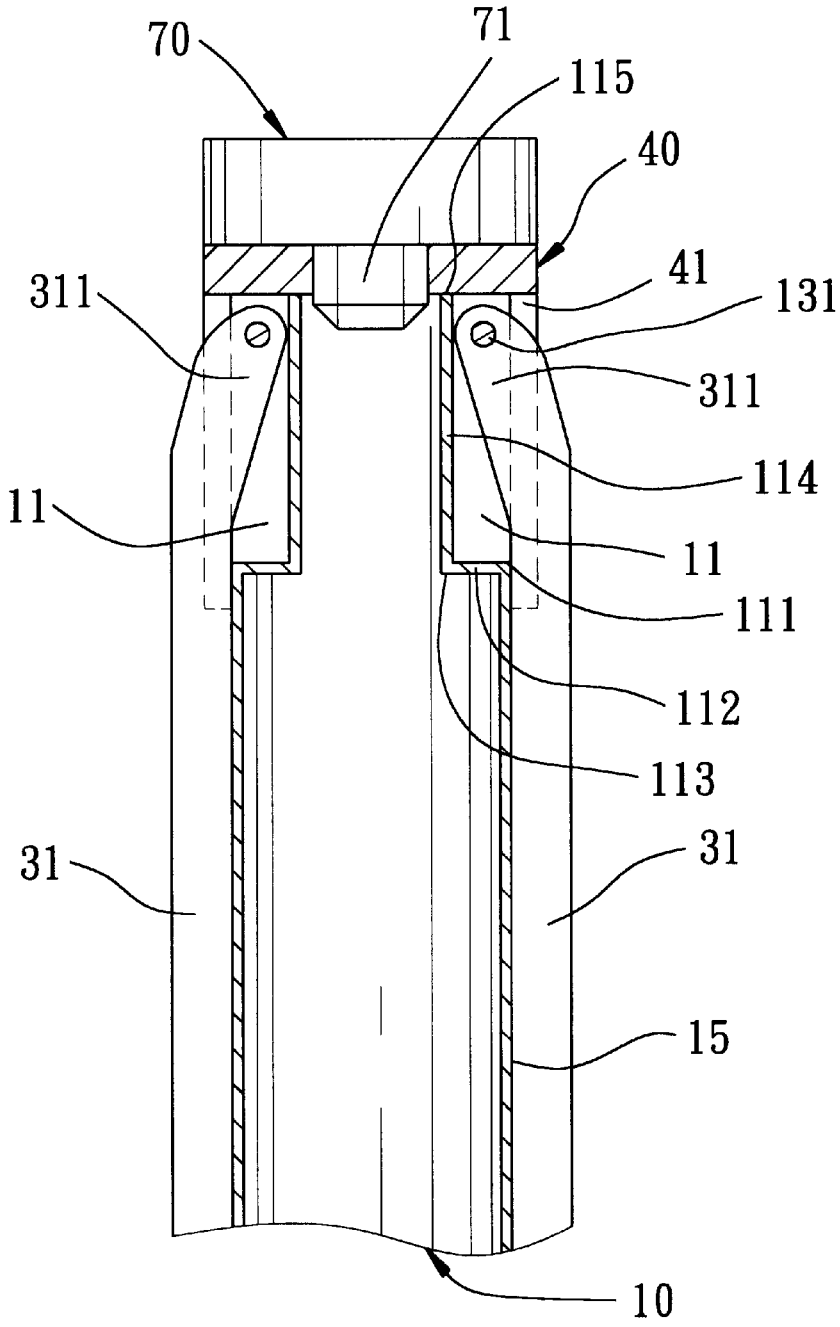
FIG. 8 is a partly sectional view of the preferred embodiment of FIG. 6 in a collapsed state.

Referring to FIGS. 6 to 8, another preferred embodiment of the umbrella according to this invention is shown to be similar to the above embodiment in construction. The upper end portion 15 of the stem 10 further has a plurality of lower slot walls 112 and a plurality of barrier walls 114. The lower slot walls 112 are formed integrally and respectively with the slot edge walls 111, and extend radially and inwardly therefrom relative to the axis to terminate at lower barrier edges 113, respectively. The barrier walls 114 are formed integrally and respectively with the lower barrier edges 113, and extend upwardly and respectively therefrom along the axis. Each of the barrier walls 114 is disposed inwardly and radially of a respective one of the anchored segments 131 of the anchored wire 13, and terminates at a top barrier edge 115 that is flush with and that is connected with the top edge wall 151.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An umbrella comprising:

an elongate stem having a tubular upper end portion, and a lower end portion extending from said upper end portion along an axis, said upper end portion having a top edge wall with inner and outer peripheries respectively surrounding the axis, an outer surrounding wall surface which extends downwardly from said outer periphery and which surrounds the axis, and an inner surrounding wall surface which extends downwardly from said inner periphery and which is disposed opposite to said outer surrounding wall surface, said upper end portion defining a plurality of slots which are angularly displaced from one another, each of said slots extending radially and inwardly relative to the axis, extending from said top edge wall toward said lower end portion, and terminating at a slot edge wall;

an anchored wire extending around the axis, and disposed inwardly and radially of said inner surrounding wall surface, said anchored wire having a plurality of anchored segments that are disposed to be respectively exposed from said slots such that each of said anchored segments is accessible radially, each of said anchored segments being disposed proximate to said top edge wall along the axis;

a canopy mounted on said top edge wall;

a cap member disposed to fasten said canopy to said top edge wall;

a rib assembly including a plurality of ribs, each of said ribs having an anchoring end which is pivoted to a respective one of said anchored segments, a distal end which is disposed opposite to said anchoring end radially of the axis and which is disposed at an underside of said canopy to support said canopy in a spread-out position and in a collapsed position, and a bent portion which extends from said anchoring end toward said distal end and which is formed by bending a respective one of said ribs which is adjacent to said anchoring end towards the axis, thereby bringing said bent portion closer to said slot edge wall;

a tubular runner slidably sleeved on said stem, and movable between upper and lower positions which respectively correspond to the spread-out and collapsed positions of said canopy; and a stretcher assembly disposed to interconnect said rib assembly and said runner so as to stretch or retract said rib assembly, thereby placing said canopy in the spread-out position or the collapsed position when said runner is moved to the upper position or the lower position, respectively.

2. The umbrella of claim 1, wherein said upper end portion of said stem further has a plurality of lower slot walls, each of which extends radially and inwardly from said slot edge wall relative to the axis and each of which terminates at a lower barrier edge, and a plurality of barrier walls, each of which extends upwardly from said lower barrier edge of a respective one of said lower slot walls along the axis, each of said barrier walls being disposed inwardly and radially of a respective one of said anchored segments of said wire, and terminating at a top barrier edge that is flush with said top edge wall.

3. The umbrella of claim 2, wherein said upper end portion of said stem is of an integrally single-piece construction such that said lower slot walls and said barrier walls are respectively and integrally formed with said slot edge walls and said top edge wall.

4. The umbrella of claim 1, further comprising a support mount having a lower major wall surface which abuts against said top edge wall, and an upper major wall surface which is disposed under said canopy and which is formed with a threaded hole that extends along the axis, said cap member having a threaded bolt which extends along the axis and which engages threadedly said threaded hole so as to clamp said canopy between said cap member and said support mount.

5. The umbrella of claim 4, wherein said support mount further has a plurality of elongate limiting portions which extend downwardly from a periphery of said lower major wall surface and which are displaced angularly from one another about the axis, each of said limiting portions being disposed radially and outwardly of said outer surrounding wall surface and between two adjacent ones of said slots such that pivotal movement of said ribs relative to said anchored segments is stabilized and wavering of said ribs is prevented.

* * * * *